US009764247B2

(12) United States Patent
Sinclair-Nitschke

(10) Patent No.: US 9,764,247 B2
(45) Date of Patent: Sep. 19, 2017

(54) TOY SUPPORT

(71) Applicant: Amanda M. Sinclair-Nitschke, Perrysburg, OH (US)

(72) Inventor: Amanda M. Sinclair-Nitschke, Perrysburg, OH (US)

( * ) Notice: Subject to any disclaimer, the term of this patent is extended or adjusted under 35 U.S.C. 154(b) by 82 days.

(21) Appl. No.: 14/163,299

(22) Filed: Jan. 24, 2014

(65) Prior Publication Data

US 2014/0370778 A1 Dec. 18, 2014

Related U.S. Application Data

(60) Provisional application No. 61/756,063, filed on Jan. 24, 2013.

(51) Int. Cl.
*A47B 96/06* (2006.01)
*A63H 33/00* (2006.01)

(52) U.S. Cl.
CPC ..... *A63H 33/006* (2013.01)

(58) Field of Classification Search
None
See application file for complete search history.

(56) References Cited

U.S. PATENT DOCUMENTS 355,663 A * 1/1887 Price ..... A63H 33/006 116/170
2,785,503 A 3/1957 Schafer
3,978,610 A 9/1976 Stubbmann
4,188,745 A * 2/1980 Harvey ..... A63H 33/006 446/227
4,664,640 A * 5/1987 Shindo ..... A63H 33/006 446/227
4,994,075 A * 2/1991 Smith ..... A61J 17/00 24/301
5,076,520 A 12/1991 Bro
D374,692 S 10/1996 Stroud et al.
6,016,926 A * 1/2000 Smith, II ..... A63H 33/006 211/118
6,194,664 B1 2/2001 Zamora et al.
6,367,211 B1 4/2002 Weener et al.
6,601,803 B1 8/2003 Juranek
6,640,985 B1 * 11/2003 Cheng ..... A63H 33/006 211/118
6,739,936 B1 * 5/2004 Cotilletta ..... A63H 3/50 248/125.8
6,860,786 B2 * 3/2005 Oren ..... B62B 9/26 446/227
7,025,654 B2 * 4/2006 Oren ..... A63H 33/006 446/227
RE41,121 E * 2/2010 Asbach ..... B60N 2/2821 297/188.06
7,669,818 B2 3/2010 Prime
8,460,053 B2 * 6/2013 Fair ..... A63H 33/006 446/227
2003/0218105 A1 11/2003 Sones et al.
2004/0063381 A1 * 4/2004 Norman ..... A63H 33/006 446/227

(Continued)

*Primary Examiner* — Sunit Pandya

(57) ABSTRACT

A toy support including a connecting element disposed at first end of the toy support, a stopper element disposed at a second end of the toy support opposite the first, at least one flexible member disposed between the first end and the second end, and at least one rigid member disposed between the first end and the second end.

20 Claims, 3 Drawing Sheets

(56) References Cited

U.S. PATENT DOCUMENTS

| | | | | |
|---|---|---|---|---|
| 2004/0079843 | A1 | 4/2004 | Medwed et al. | |
| 2006/0168765 | A1* | 8/2006 | Beatty | A45F 5/02 24/3.13 |
| 2006/0183396 | A1* | 8/2006 | Kanahele | A63H 33/006 446/26 |
| 2006/0289713 | A1 | 12/2006 | Kaplan et al. | |
| 2011/0057084 | A1* | 3/2011 | Thompson | A47D 15/00 248/314 |

* cited by examiner

TOY SUPPORT

CROSS-REFERENCE TO RELATED APPLICATION

This application claims the benefit of U.S. Provisional Patent Application Ser. No. 61/756,063 filed on Jan. 24, 2013. The entire disclosure of the above provisional patent application is hereby incorporated herein by reference.

FIELD OF THE INVENTION

The invention relates to a toy support, and more specifically to a toy support for receiving one or more toys and/or teethers.

BACKGROUND

The baby and toddler consumer markets are flooded with baby teethers, baby toys and toddler toys for purchase. Babies and toddlers go through a significant period of time when they explore teethers and toys by inserting them into their mouth. For this reason, baby and toddler teethers and toys have various textures, colors, patterns and materials to stimulate the baby or toddler and to provide relief when the baby or toddler is teething. Baby and toddler teethers and toys come in various shapes and sizes and often include one or more apertures that allow the baby or toddler to easily grasp the teether or toy.

Babies and toddlers often drop and/or throw teethers and toys to the ground. This can be a source of frustration for parents and other caregivers because the teethers and toys pick up dirt and germs when they hit the ground. It can also be exhausting to continually pick up the same toy over and over again, while the baby or toddler views it as a fun game. For many parents, teethers and toys require disinfecting when they hit the ground because they ultimately end up in the baby or toddler's mouth again.

Many parents and caregivers also find it difficult to organize and transport baby and toddler toys. While throwing teethers and toys in a diaper bag or other carrier is one option, it can be unsanitary and very disorganized. Additionally, babies and toddlers cannot easily access the teethers and toys when they are secured in a bag.

Certain products exist that are meant to connect an item such as a pacifier or a bottle, for example, to a baby or baby carrier, however, these items each have limitations. For example, the element connecting the pacifier or the bottle to the baby must be very short in order to prevent the element from wrapping around the baby or toddler's neck. Alternatively, if the element connecting the pacifier or the bottle to the baby or toddler is longer, risk of strangulation is a serious issue. Additionally, these products do not allow for additional teethers and/or toys to be organized, transported, and made accessible to the baby or toddler.

It would be desirable to have a toy support that is safe for a baby or toddler to use, prevents teethers and toys from hitting the ground when routinely thrown or dropped, and allows for easy organization, transport, and use of multiple teethers and toys at one time.

SUMMARY OF THE INVENTION

Consonant with the present invention, a toy support that is safe for a baby or toddler to use, prevents teethers and toys from hitting the ground when routinely thrown or dropped, and allows for easy organization, transport, and use of multiple teethers and toys has surprisingly been discovered.

In one embodiment of the invention, the toy support comprises a connecting element disposed at a first end of the toy support, a stopper element disposed at a second end of the toy support opposite the first, at least one flexible member disposed between the first end and the second end, and at least one rigid member disposed between the first end and the second end.

In another embodiment of the invention, the toy support comprises a connecting element at a first end of the toy support and a stopper element removeably connected to a second end of the toy support opposite the first end. The toy support further includes a first flexible member positioned adjacent the first end of the toy support, a second flexible member positioned adjacent the second end of the toy support, and a rigid member disposed between the first flexible member and the second flexible member. One or more objects having at least one threading aperture may be threaded on the toy support when the stopper element is removed from the toy support.

In yet another embodiment of the invention, the toy support includes a connecting element at a first end of the toy support and a baby teether removeably connected to a second end of the toy support opposite the first end. The toy support further includes a first flexible member positioned adjacent the first end of the toy support, a second flexible member positioned adjacent the second end of the toy support, and a rigid member disposed between the first flexible member and the second flexible member. At least one object having at least one threading aperture may be threaded on at least one of the first flexible member, the second flexible member, and the rigid member of the toy support when the stopper element is removed from the toy support. The stopper element secures the at least one object having a threading aperture onto the toy support when the stopper element is connected to the toy support.

BRIEF DESCRIPTION OF THE DRAWINGS

The above, as well as other objects and advantages of the invention, will become readily apparent to those skilled in the art from the following detailed description of embodiments of the invention when considered in the light of the accompanying figures, in which.

DETAILED DESCRIPTION OF AN EMBODIMENT OF THE INVENTION

The following detailed description and appended drawings describe and illustrate exemplary embodiments of the invention. The description and drawings serve to enable one skilled in the art to make and use the invention, and are not intended to limit the scope of the invention in any manner.

Figure 1:
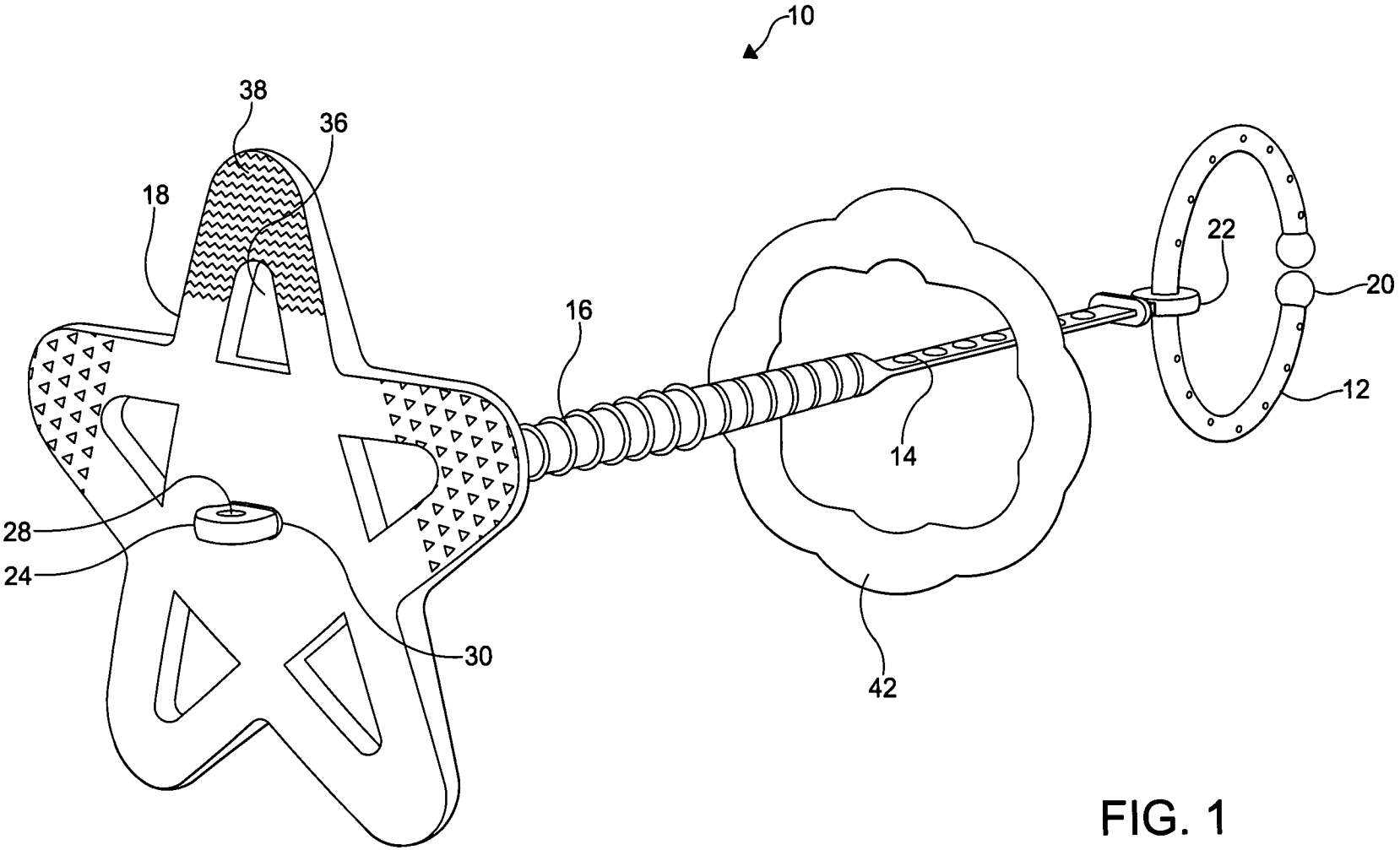
FIG. 1 is a bottom perspective view of the toy support according to an embodiment of the invention.
Figure 2A:
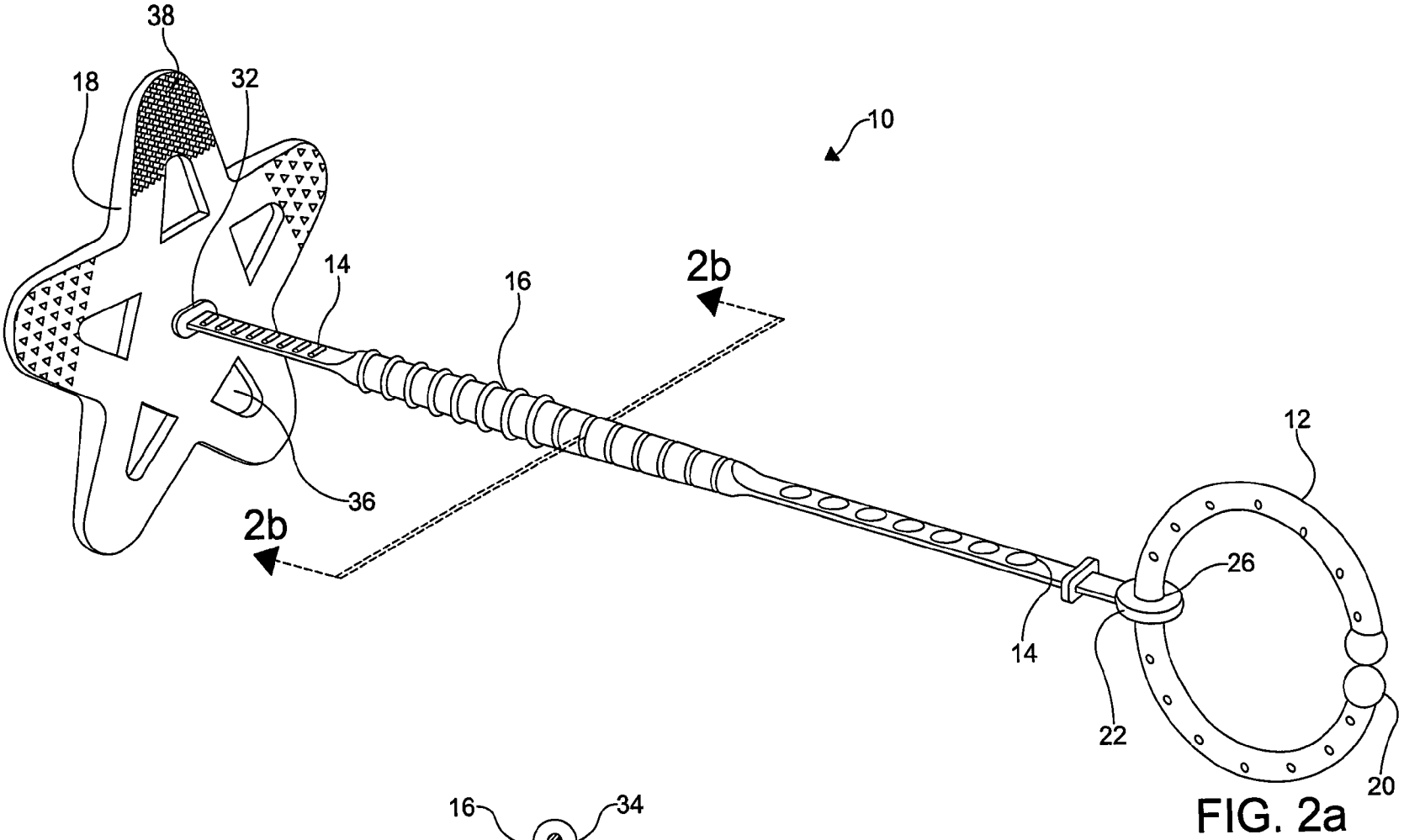
FIG. 2*a* is a top perspective view of the toy support shown in FIG. 1.
Figure 2B:
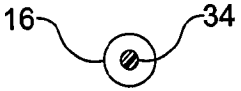
FIG. 2*b* is a cross-sectional elevational view of a rigid member of the toy support shown in FIG. 2*a*.

Referring to FIGS. 1 and 2, there is illustrated a toy support, generally indicated by reference numeral 10. The toy support 10 includes a connecting element 12, at least one flexible member 14, at least one rigid member 16, and a stopper element 18.

The toy support 10 may be made from any baby and toddler safe material such as plastic, silicone, polyester, cloth, wood, or rubber, for example. Preferably the toy support 10 is made from a material that is BPA free, easy to clean, and dishwasher safe. The toy support 10 may be one integral component or several components attached to one another. The toy support 10 may be any color, shape, size, or design, as desired. A weight of the toy support 10 should be appropriate for use by a baby or toddler but may vary in certain embodiments handled primarily by adults.

The connecting element 12 may be any connecting element 12 capable of connecting the toy support 10 to an object such as a baby travel system, a high chair, a crib, a playpen, a stroller, a belt buckle, or a clothing strap, for example. In certain embodiments, the connecting element 12 may wrap around and secure itself to the object using a clip mechanism, a snap mechanism, a tie mechanism, a hook and loop mechanism, a loop mechanism through which the toy support 10 passes in order to secure the toy support 10 to the object, or any other easy to use mechanism for connecting the toy support 10 to another object. Any suitable shape and size may be used for the connecting element 12. Additionally, any texture such as smooth or bumpy, for example, and color may be used for the connecting element 12.

In certain embodiments, as shown in FIGS. 1 and 2, the connecting element 12 may have one or more reinforcing members 20 disposed along a length of the connecting element 12 that improve and strengthen a connection between the connecting element 12 of the toy support 10 and the object the toy support is connected to and that mitigate against any pressure that may be exerted on the toy support 10 and/or connecting element 12 when in use.

The connecting element 12 may be made from a rigid or a flexible material such as plastic, metal, cloth, rubber, or silicon, for example. The connecting element 12 may include ridges or other locking elements (not shown) that secure or lock a portion of at least one of the at least one flexible member 14 or the at least one rigid member 16 in place such that the at least one flexible member 14 or the at least one rigid member 16 cannot rotate or move along a length of the connecting element 12.

The at least one flexible member 14 may be made from one or more flexible materials such as silicone, elastic, rubber, plastic, or cloth, for example, or any other material the baby or toddler may safely chew on and touch. A surface of the at least one flexible member 14 may be smooth or textured and a thickness and a length of the at least one flexible member 14 may vary according to different embodiments. A cover (not shown) may be disposed over at least a portion of the at least one flexible member 14 in certain embodiments.

The at least one flexible member 14 may be connected to the connecting element 12 by a first connecting means 22 as shown in FIGS. 1 and 2. The at least one flexible member 14 may alternatively be connected to the stopper element 18 by way of a second connecting means 24. In certain embodiments, the at least one flexible member 14 may be connected to both the connecting element 12 and the stopper element 18, or may not be connected to either one. The first connecting means 22 and/or the second connecting means 24 may be integral with the at least one flexible member 14 (as shown in FIGS. 1 and 2) or separate components. The first connecting means 22 may include a first aperture 26 and the second connecting means 24 may include a second aperture 28 in certain embodiments of the disclosure. The first connecting means 22 and the second connecting means 24 may be the same or different. In embodiments where the first connecting means 22 and the second connecting means 24 are the same, they may be used interchangeably with the connecting element 12 and the stopper element 18 (as shown in FIGS. 1 and 2). Examples of possible connecting means 22, 24 include but are not limited to tie mechanisms, snap mechanisms, screw mechanisms, loop mechanisms, friction fit mechanisms, and insert mechanisms. As shown in FIGS. 1 and 2, in certain embodiments, the first aperture 26 of the first connecting means 22 may be disposed around a portion of the connecting element 12 in order to secure the at least one flexible member 14 to the connecting element 12 and the second connecting means 24 may be inserted into a stopper aperture 30 in order to secure the at least one flexible member 14 to the stopper element 18.

There may be a plurality of flexible members 14 removeably or permanently connected to one another or to the at least one rigid member 16 using any connecting mechanism such as a tie mechanism or a snap mechanism, for example. The at least one flexible member 14 may be made from an elastic material that allows the length of the at least one flexible member 14 to vary.

The at least one rigid member 16 may be made from any rigid material such as metal or plastic, for example. In certain embodiments (as shown in FIGS. 2 and 2*a*), the at least one rigid member 16 may be a rigid insert 34. The rigid insert 34 may be disposed in a portion of the at least one flexible member 14, or may be surrounded by a material suitable for a baby or toddler to chew on and/or play with that is connected to or integral with the at least one flexible member 14. The rigid insert may be made of any rigid material such as metal or plastic, for example. Alternatively, the at least one rigid member 16 may be made from a material that is safe for babies and toddlers to chew on and handle and may not include a cover. The at least one rigid member 16 may be integral with or a separate component from the at least one flexible member 14. In certain embodiments, the rigid member 16 may be disposed between two flexible members 14, as shown in FIGS. 1 and 2. For example, a flexible member 14 may be connected to the connecting element 12 of the toy support and another flexible element 14 may be connected to the stopper element 18. A rigid member 16 may be disposed between the flexible member 14 that is connected to the connecting element 12 and the flexible member 14 that is connected to the stopper element 18. In alternative embodiments, the at least one rigid member may also be a rigid cover that encompasses at least a portion of the at least one flexible member 14. The at least one rigid member 16 may be any suitable length, thickness, shape, and size, and may include a textured or smooth surface for the baby and toddler to chew on or play with.

There may be a plurality of rigid members 16 removeably or permanently connected to one another, or alternating in a pattern or randomly between the at least one flexible member 14. The at least one rigid member 16 and the at least one flexible member 14 may be integral with one another or separate components.

The at least one rigid member 16 may be connected to the connecting element 12 using a connecting means (not shown). The at least one rigid member 16 may alternatively be connected to the stopper element 18 using connecting means (not shown). In certain embodiments, the at least one rigid member 16 may be connected to both the connecting element 12 and the stopper element 18, or may not be connected to either one. The connecting means may be integral with the at least one rigid member 16 or separate components. Examples of possible connecting means include but are not limited to tie mechanisms, snap mechanisms, screw mechanisms, loop mechanisms, friction fit mechanisms, and insert mechanisms. The connecting means may include apertures as described in paragraph [0023].

The stopper element 18 may be made from one component or more than one component and may be any size, shape, thickness, hardness, color, and texture, as desired. The stopper element 18 may be made from any appropriate material such as silicone, plastic, or cloth, for example. In certain embodiments, the stopper element 18 is removeably connected to one or more of the at least one flexible member 14, the second connecting means 24, the at least one rigid member 16, and/or the rigid member connecting means by any appropriate means such as by a snap mechanism, a tie mechanism, a friction fit mechanism, or a screw mechanism, for example. As shown in FIGS. 1 and 2, in certain embodiments a portion of the at least one flexible member 14 may be inserted into the stopper aperture 30 and secured with a friction fit. An insert aperture 32 may allow a the portion of the at least one flexible member 14 to collapse when squeezed by a user prior to insertion in order to make insertion easier. Once the user inserts the portion of the at least one flexible member and ceases to squeeze the portion of the at least one flexible member, the diameter of the portion of the at least one flexible member returns to normal and locks the stopper element 18 in place. A size and shape of the stopper element 18 must be appropriate for preventing one or more toys 42 and/or teethers from exiting the toy support 10 once they are strung on the at least one flexible member 14 and/or the at least one rigid member 16. In certain embodiments, the stopper element 18 is a baby or toddler teether, a baby or toddler toy, or a bottle for a baby or child.

Figure 3:
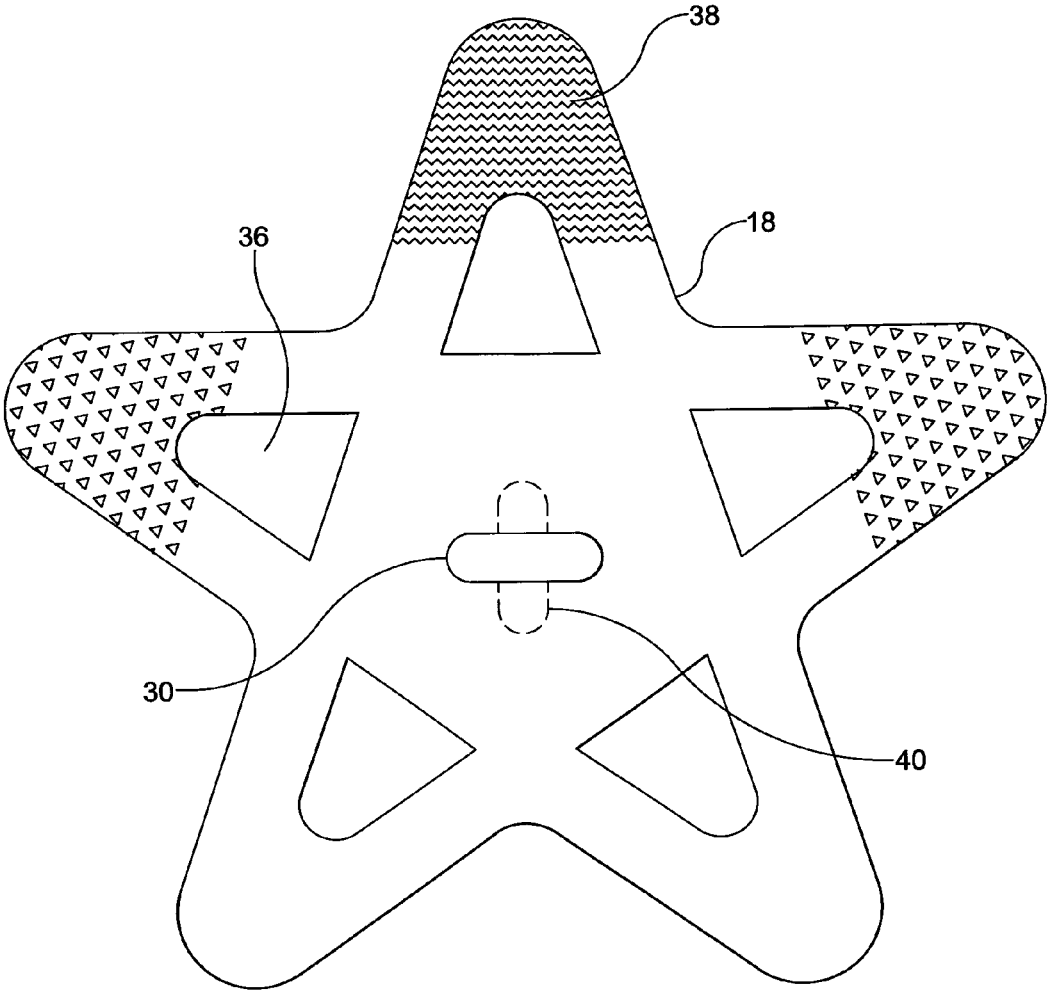
FIG. 3 is an elevational view of a stopper element of a toy support according to another embodiment.

The stopper element 18 may include one or more gripping apertures 36 and/or one or more textured surfaces 38. The one or more gripping apertures 36 may be any appropriate size and shape for a baby or toddler to grasp. The one or more textured surfaces 38 may be any texture soothing to a baby or toddler's gums. In certain embodiments, the stopper element 18 may include grooves 40, as shown in FIG. 3, positioned perpendicular to the stopper aperture 30. The grooves 40 receive one or more of the at least one flexible member 14, the connecting means 24, the at least one rigid member 16, and the rigid member connecting means and lock it in place upon insertion and rotation of the at least one flexible member 14, the connecting means 24, the at least one rigid member 16, and/or the rigid member connecting means about ninety degrees. The stopper aperture 30 may be any shape and size appropriate for receiving or connecting to at least one of the at least one flexible member 14, the connecting means 24, the at least one rigid member 16, and the rigid member connecting means.

In alternate embodiments, additional stopper elements 18 may be connected to the toy support 10 at various positions along a length of the toy support 10, for example, at various positions along the at least one flexible member 14 and/or the at least one rigid member 16. Likewise, additional means for connecting objects such as bottles, pacifiers, baby blankets, snack bags, stuffed animals, and/or any other item, for example, may be disposed along the length of the toy support 10, as desired.

In use, a user secures the toy support 10 using the connecting element 12 to an object such as a travel system, a high chair, a table, an article of clothing, or a stroller, for example. This allows for the baby or toddler to play with and chew on the stopper element 18, but does not allow the baby or toddler to throw the stopper element 18 or the toy support 10 onto the ground.

The toy support 10 may also be used with other baby, toddler, and children's toys 42 and/or teethers. In fact, any toy 42 and/or teether having an aperture may be strung along the length of the at least one flexible member 14 and/or the length of the at least one rigid member 16 by removing the stopper element 18 and inserting the at least one flexible member 14 and/or the at least one rigid member 16 through the aperture of the toy 42 and/or teether. Once the toy 42 and/or teether is disposed around the at least one flexible member 14 and/or the at least one rigid member 16, the stopper element 18 is once again connected to one or more of the at least one flexible member 14, the connecting means 24, the at least one rigid member 16, and/or the rigid member connecting means in order to secure the toy 42 and/or teether to the toy support 10. In certain embodiments, the toy 42 and/or teether may be strung onto the toy support 10 by removing at least one of the at least one flexible member 14, the connecting means 22, the at least one rigid member 16, and/or the rigid member connecting means connected to the connecting element 12 and then reapplying the connecting element 12 once the toy 42 and/or teether has been added. Alternatively, certain toys 42 and/or teethers may have their own means for connecting to the toy support 10, such as a clip mechanism or a tie mechanism, for example, and may not require an aperture or removal of the stopper element 18 in order to secure the toys 42 and/or teethers to the toy support 10. The stopper element 18 prevents the toys 42 and/or teethers from exiting the toy support 10. As such, when the toy support 10 is secured to an object, a baby or toddler can play with and chew on the toys 42 and/or teethers, but cannot throw the toys 42 and/or teethers onto the ground. This keeps the toys 42 and/or teethers from picking up germs on the ground, prevents a parent or other caregiver from routinely bending down to pick up the toys 42 and/or teethers, and prevents the toys 42 and/or teethers from being misplaced after having fallen to the ground. The baby or toddler is happy to have the toys 42 and/or teethers within reach and easy to play with at all times during a stroller ride, a car ride, or during a meal at a restaurant, for example.

The toy support 10 may also be used to store, organize, and transport toys. Often, parents and caregivers are stuck throwing toys 42 and/or teethers into the bottom of a diaper bag. This can be very disorganized and unsanitary. The toy support 10 allows the user to string multiple toys 42 and/or teethers onto one item for clean and easy organization or storage, and the toy support 10 is easy to transport to various locations by connecting the toy support 10 to a diaper bag, stroller, belt buckle, or any other object. The stopper element 18 and all other toys 42 and/or teethers connected to the toy support 10 are easy to reach and quickly connect to an object for use by the baby or toddler.

The length of the toy support 10 may vary and be changed by a user in certain embodiments, as desired, by changing the number of flexible members 14 and rigid members 16 included. Additionally, the connecting element 12 may connect to multiple flexible members 14 and/or rigid members 16 that are connected to multiple stopper elements 18 in certain embodiments, thereby allowing for toys 42 and/or teethers to be strung on a variety of flexible members 14 and/or rigid members 16 and secured by one of several stopper elements 18.

From a safety standpoint, the at least one rigid member 16 inhibits the toy support 10 from wrapping around a neck of the baby, toddler, or child and minimizes a risk of strangulation. The at least one flexible member 14 allows the stopper element 18 and/or the toys 42 and/or teethers to be easily moved and played with by the baby or toddler. In certain embodiments, the at least one rigid member 16 may be such a length as to not allow the at least one gripping apertures 36 to connect to the connecting element 12, thereby inhibiting the toy support 10 from forming a circular object that might get stuck-around the neck of the baby or toddler.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A toy support comprising:

a connecting element at a first end of the toy support;

a stopper element disposed at a second end of the toy support opposite the first end;

at least one flexible member disposed between the first end and the second end; and at least one rigid member disposed between the first end and the second end;

wherein the at least one flexible member includes a connecting means;

wherein the connecting means is secured to the connecting element;

wherein at least one object having at least one threading aperture may be threaded onto the toy support and advanced along a length of the toy support; and wherein the length of the toy support includes the at least one rigid member.

2. The toy support according to claim 1, wherein the toy support is formed from at least one of cloth, rubber, silicon, and plastic.

3. The toy support according to claim 1, wherein the stopper element is removeably connected to the second end of the toy support.

4. The toy support according to claim 1, wherein the stopper element includes a connecting aperture through which the second end of the toy support is removeably inserted.

5. The toy support according to claim 4, wherein the stopper element includes at least one groove positioned perpendicular to the connecting aperture for receiving a portion of the second end of the toy support.

6. The toy support according to claim 1, wherein the stopper element is at least one of a baby teether and a toy.

7. The toy support according to claim 1, wherein the stopper element is made from at least one of silicon, rubber, and plastic.

8. The toy support according to claim 1, wherein the stopper element includes one or more gripping apertures.

9. The toy support according to claim 1, wherein the at least one rigid member includes an aluminum bar covered by at least one of cloth, rubber, silicon, and plastic.

10. The toy support according to claim 1, wherein the rigid member is disposed around at least a portion of the at least one flexible member.

11. The toy support according to claim 3, wherein the at least one object having at least one threading aperture may be threaded onto the toy support when the stopper element is removed from the toy support.

12. The toy support according to claim 1, wherein the at least one rigid member is disposed between a first flexible member and a second flexible member.

13. The toy support according to claim 1, wherein the first connecting element is one of a clip mechanism, a tie mechanism, and a snap mechanism.

14. The coy support according to claim 4, wherein the second end of the toy support is rotated 90 degrees upon insertion of the second end through the connecting aperture and is secured in place by at least one groove disposed on the stopper element.

15. The toy support according to claim 4, wherein the second end of the toy support includes insert having an insert aperture in a center of the insert, and wherein the insert is squeezed by a user when inserting the second end of the toy support into the stopper element.

16. The toy support according to claim 1, wherein each of the stopper element, the at least one rigid member, and the at least one flexible member include at least one textured surface.

17. A toy support comprising:

a connecting element at a first end of the toy support;

a stopper element removeably connected to a second end of the toy support opposite the first end;

a first flexible member positioned adjacent the first end of the toy support;

a second flexible member positioned adjacent the second end of the toy support; and a rigid member disposed between the first flexible member and the second flexible member;

wherein at least one object having at least one threading aperture may be threaded onto the toy support and advanced along a length of the toy support when the stopper element is removed from the toy support;

wherein the length of the toy support includes the at least one rigid member;

wherein the first flexible member includes a connecting means; and wherein the connecting means is secured to the connecting element.

18. The toy support according to claim 17, wherein the toy support receives at least one of a baby teether and a baby toy.

19. The toy support according to claim 17, wherein the stopper element secures the at least one object having at least one threading aperture on the toy support when the stopper element is connected to the second end of the toy support.

20. A toy support comprising:

a connecting element at a first end of the toy support;

a baby teether removeably connected to a second end of the toy support opposite the first end;

a first flexible member positioned adjacent the first end of the toy support;

a second flexible member positioned adjacent the second end of the toy support; and a rigid member disposed between the first flexible member and the second flexible member;

wherein at least one object having at least one threading aperture may be threaded onto the toy support and advanced along a length of the toy support when the baby teether is removed from the toy support;

wherein the length of the toy support includes the at least one rigid member;

wherein the baby teether secures the at least one object having at least one threading aperture on the toy support when the baby teether is connected to the toy support;

wherein the first flexible member includes a connecting means at a first end of the first flexible member; and wherein the connecting means is disposed around and secured to the connecting element.

* * * * *